US008608161B2

(12) United States Patent
Hirai et al.

(10) Patent No.: US 8,608,161 B2
(45) Date of Patent: Dec. 17, 2013

(54) SHEET STACKING APPARATUS AND IMAGE FORMING APPARATUS

(75) Inventors: Ko Hirai, Toride (JP); Akihiro Mitomo, Chichibu (JP)

(73) Assignee: Canon Kabushiki Kaisha, Tokyo (JP)

( * ) Notice: Subject to any disclaimer, the term of this patent is extended or adjusted under 35 U.S.C. 154(b) by 319 days.

(21) Appl. No.: 12/830,668

(22) Filed: Jul. 6, 2010

(65) Prior Publication Data

US 2011/0006472 A1 Jan. 13, 2011

(30) Foreign Application Priority Data

Jul. 10, 2009 (JP) ..... 2009-163415
Jun. 24, 2010 (JP) ..... 2010-143393

(51) Int. Cl.
*B65H 31/26* (2006.01)

(52) U.S. Cl.
USPC ..... 271/220; 271/207

(58) Field of Classification Search
USPC ..... 271/207, 209, 220, 224
See application file for complete search history.

(56) References Cited

U.S. PATENT DOCUMENTS 1,887,023 A * 11/1932 Hunziker ..... 271/220
2,916,286 A * 12/1959 Keating ..... 271/220
2,991,999 A * 7/1961 Doerner ..... 271/220
3,805,971 A * 4/1974 Behrens et al. ..... 414/789
5,260,759 A * 11/1993 Kobayashi ..... 399/405
5,284,337 A * 2/1994 Ettischer et al. ..... 271/220
5,467,974 A * 11/1995 Ishiwata et al. ..... 271/220
5,524,877 A * 6/1996 Weber et al. ..... 271/220
7,677,557 B2 * 3/2010 Ino ..... 271/220
7,686,296 B2 * 3/2010 Kaneko et al. ..... 271/220
7,828,288 B2 * 11/2010 Kim et al. ..... 271/200
2002/0158406 A1 * 10/2002 Moeller et al. ..... 271/220
2003/0160385 A1 * 8/2003 Furusawa ..... 271/220
2004/0251608 A1 * 12/2004 Saito et al. ..... 271/220
2006/0071413 A1 * 4/2006 Kaneko et al. ..... 271/220
2007/0069454 A1 * 3/2007 Ino ..... 271/220
2009/0001659 A1 * 1/2009 Mcnamara et al. ..... 271/220

FOREIGN PATENT DOCUMENTS

JP 2003-300661 A 10/2003

* cited by examiner

*Primary Examiner* — Prasad Gokhale
(74) *Attorney, Agent, or Firm* — Fitzpatrick, Cella, Harper & Scinto

(57) ABSTRACT

A holding portion includes a engagement portion which holds a sheet pressing lever which presses from above a sheet discharged into a sheet stacking portion so that the engagement portion moves upward together with an image reading portion rotatably provided above an image forming portion, and an elastic portion which elastically deforms to release the holding of the sheet pressing lever by the engagement portion. If a force is applied to the sheet pressing lever being held by the holding portion in a direction which makes the lever rotate even lower than its lower limit position, the elastic portion elastically deforms to release the holding of the sheet pressing lever by the engagement portion.

12 Claims, 6 Drawing Sheets

SHEET STACKING APPARATUS AND IMAGE FORMING APPARATUS

BACKGROUND OF THE INVENTION

1. Field of the Invention

The present invention relates to a sheet stacking apparatus used in fax machines, copying machines, printers, and multifunction machines combining the functions thereof, and an image forming apparatus including the sheet stacking apparatus.

2. Description of the Related Art

Recently, it has become increasingly necessary to miniaturize the apparatus main body of an image forming apparatus of fax machines, copying machines, printers, and multifunction machines combining the functions thereof. For example, in order to avoid increasing the footprint of the apparatus, a sheet stacking portion which stacks discharged sheets on which an image is formed and discharged original copies from which an image is read is provided above the apparatus main body. Further, an image forming apparatus in which an image reading portion which reads the image of an original copy is provided above the sheet stacking portion is known, as well as one having an upper unit such as an upper level sheet stacking portion among a plurality of sheet stacking portions.

In this kind of apparatus, as a further method for miniaturizing the apparatus main body, the size of a sheet stacking space including the top surface of the sheet stacking portion and the lower surface of the upper unit can be reduced.

In an apparatus in which the size of the sheet stacking space has been reduced, in order to secure a certain amount of sheet stacking, a sheet pressing lever which presses down any bulging of the stacked sheets can be provided. Alternatively, in order to prevent overstacking of the sheets, a member which detects the amount of sheet stacking via a stacking amount detection lever can be provided. In general, a sheet pressing lever or a stacking amount detection lever is provided so that it can rotate in the up-down direction, which is the stacking direction of the sheets, and the lever is held at a lower limit position of a movement region in which the lever can rotate by a regulation portion which regulates the rotation of the lever.

Therefore, as a lever breakage prevention portion for when a force is applied in a direction which makes the lever rotate even lower than the lower limit position of the movement region, Japanese Patent Application Laid-Open No. 2003-300661 discloses arranging a spring member on a regulation portion which regulates the lower limit position of rotation of a stacking amount detection lever. Thereby, when a force is applied in a direction which makes the lever rotate even lower than the lower limit position in a state in which the upper unit is closed, the regulation portion is displaced by the elasticity of the spring member and the top surface of the sheet stacking portion regulates the rotation of the lever, thus breakage of the stacking detection lever is avoided.

However, in a state in which the upper unit is opened upward, the space from the rotating edge of the lever to the top surface of the sheet stacking portion is larger than that in the state in which the upper unit is closed, and thus the rotation of the lever cannot be regulated at the top surface of the sheet stacking portion. In a state in which the upper unit is opened, even if the technology disclosed in Japanese Patent Application Laid-Open No. 2003-300661 is used, since there are limits to the elasticity displacement magnitude (rotation range) of the lever by the spring member, the lever may break if a force exceeding the rotation range is applied to the lever.

The present invention provides a sheet stacking apparatus in which a lever held in a lower limit position will not break even if a force is applied in a direction which makes the lever rotate even lower than the lower limit position, and the back action of the lever can be reduced even if the force is released.

SUMMARY OF THE INVENTION

According to the present invention, there is provided a sheet stacking apparatus including: an apparatus main body which provides a discharge portion from which a sheet is discharged; an upper unit, provided above the apparatus main body, which can move upward with respect to the apparatus main body; a sheet stacking portion, provided between the apparatus main body and the upper unit, on which a sheet discharged from the discharge portion is stacked; a lever member rotatably provided on the upper unit so that it comes into contact with the sheet stacked in the sheet stacking portion from above; and a holding portion which holds the lever member in a predetermined holding position so as to move together with the upper unit when the upper unit moves upward; wherein, when the upper unit has moved upward, if a force is applied to the lever member, held in the predetermined holding position by the holding portion, in a direction which makes the lever member rotate even lower than the predetermined holding position, the holding portion releases holding of the lever member.

According to the present invention, even if a force is applied to a lever member held by a holding portion in a direction which makes the lever member rotate even lower, the lever member will not break since the holding is released.

Further features of the present invention will become apparent from the following description of exemplary embodiments with reference to the attached drawings.

DESCRIPTION OF THE EMBODIMENTS

An exemplary embodiment of the present invention will be described in further detail below with reference to the drawings. However, the dimensions, material properties, shape, and the relative configuration thereof of the constituent portions of the embodiment described below can be appropriately changed according to the constitution of the apparatus to which the present invention is applied and various conditions. Therefore, the scope of the present invention is not limited to the constitution of the embodiment below unless otherwise particularly specified.

Figure 1A:
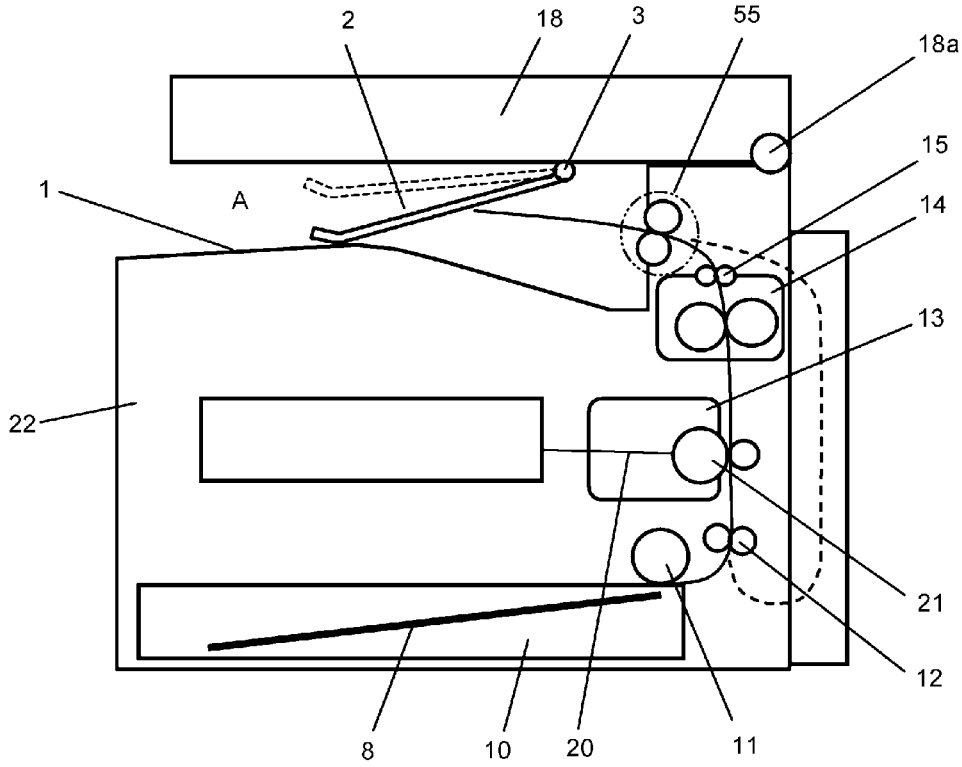
FIG. 1A is an overall constitutional descriptive view of a laser printer multifunction machine, which is one embodiment of the image forming apparatus including a sheet stacking apparatus according to a first embodiment
Figure 1B:
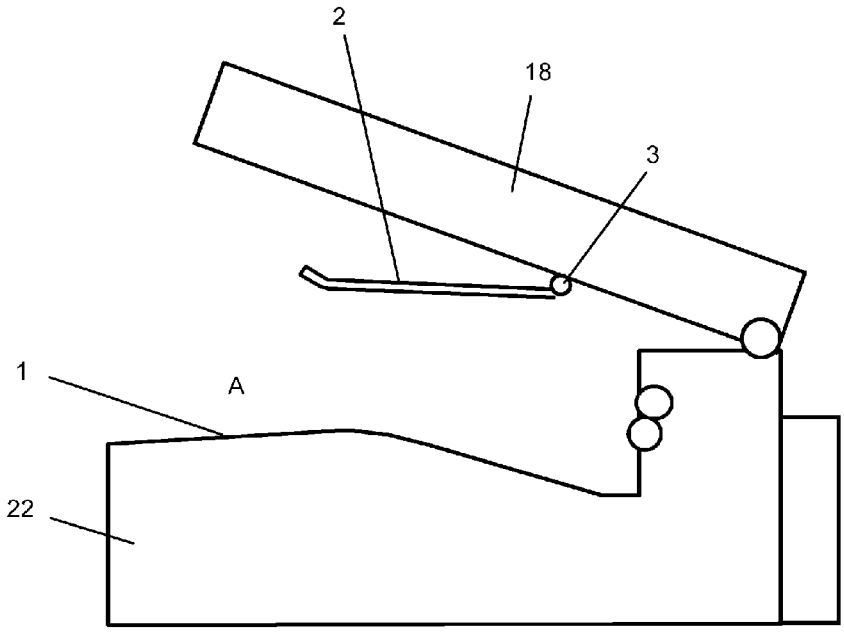
FIG. 1B is a schematic cross-section view illustrating the image forming apparatus in a state in which the image reading portion is opened upward.

First, referring to FIG. 1, the overall constitution of the image forming apparatus including the sheet stacking apparatus will be briefly described. FIG. 1A is an overall constitutional descriptive view of a laser printer multifunction machine, which is one embodiment of the image forming apparatus including the sheet stacking apparatus. FIG. 1B is a schematic cross-section view illustrating the image forming apparatus in a state in which an image reading portion 18 is opened upward. Image formation on sheets 8 in the laser printer multifunction machine is carried out as described below.

As illustrated in FIG. 1, the sheets 8 stored in a sheet cassette 10 are separately fed one at a time by a pickup roller 11 and a separating portion (not illustrated) and then sent out. The sheets 8 which have been sent out are sent to a registration roller unit 12.

Meanwhile, in a development/transfer portion 13, toner (not illustrated) is adsorbed onto a photosensitive drum 21 on which a latent image is drawn by a laser beam 20, and then development is performed.

A sheet 8 separately fed from the sheet cassette 10 is conveyed to the development/transfer portion 13 by the registration roller unit 12 so as to synchronize with the image formed on the photosensitive drum 21, and then the toner image developed on the photosensitive drum 21 is transferred to the sheet 8.

The sheet 8 onto which the toner image has been transferred is conveyed to a fixing portion 14, and thereby the image on the sheet 8 is fixed, and then the sheet 8 is transferred to a pair of discharge rollers 55 by a fixing conveying roller 15.

The sheet 8 on which image forming has been completed is discharged into a stacking space A to be described later by the pair of discharge rollers 55, which acts as a discharge portion. The sheet 8 is then stacked in page order in a sheet stacking portion 1.

In the image forming apparatus illustrated in FIG. 1, an image reading portion 18, which serves as an upper unit, is rotatably arranged above the image forming portion 22 which makes up the apparatus main body. An exterior top surface, which is on top of the image forming portion 22, is used as the sheet stacking portion 1. Further, a stacking space A for stacking the sheets is formed between the image forming portion 22 and the image reading portion 18. The image reading portion 18 is supported at a first position separated from the sheet stacking portion 1 by the stacking space A for stacking the sheets, and is rotatably (movably) arranged above the image forming portion 22 so that it can move from a first position to a second position upwardly.

The image reading portion 18 reads an image of the original copy, and in a copy function, provides the read image to the image forming portion 22.

As described above, the sheet 8 on which image forming was performed is discharged to the stacking space A by the pair of discharge rollers 55, and then neatly stacked in the sheet stacking portion 1.

However, a so-called curl phenomenon, in which the sheet can warp after image fixing, can occur in some cases due to moisture in the sheet or the type of sheet. Sheets which have curled can cause problems such as a reduction in the stacking amount of sheets stacked in the sheet stacking portion 1, or sheets can be pushed and fall out due to discharged sheets getting jammed in the discharge outlet.

In order to avoid stacking problems caused by curled sheets, a constitution which presses down bulging of curls or the like of the sheets stacked in the sheet stacking portion 1 to ensure a certain amount of stacking of the sheets is generally used. Specifically, as such a constitution, a sheet pressing lever 2 can be arranged as a lever member which is rotatably axially supported in the stacking direction of the sheets centered on an axial support 3 above the pair of discharge rollers (discharge portion) 55. The rotating edge (free edge opposite to the axial support 3) of the sheet pressing lever 2 is constituted so as to contact from above and press the top surface of the sheets 8 stacked in the sheet stacking portion 1.

When the sheets 8 are discharged by the pair of discharge rollers 55, the front edge in the discharge direction of the sheets 8 comes into contact with the sheet pressing lever 2. Further, the sheets 8 are conveyed by the pair of discharge rollers 55, and thereby the sheets 8 are discharged while elevating the rotating edge of the sheet pressing lever 2 upward and then the sheets 8 are stacked on the sheet stacking portion 1.

Recently, as a technology for reducing the height of the overall apparatus as much as possible to meet the need to miniaturize the apparatus, it is desirable to lower the space (height) in the sheet stacking direction of the stacking space A illustrated in FIG. 1.

Therefore, in order to enhance the removability of the sheets stacked in the sheet stacking portion 1, the image reading portion 18 is constituted to open upward centered on a rotation support point 18*a* with respect to the image forming portion 22 which forms the apparatus main body. For the same reason, when the image reading portion 18 opens upward, the sheet pressing lever 2 is also constituted to move upward together with the image reading portion 18.

Thereby, in the second position in which the image reading portion is opened upward, a space is secured above the sheet stacking portion 1 which is larger than the stacking space A in the first position in which the image reading portion 18 is closed, and thus the sheets 8 stacked in the sheet stacking portion 1 become easy to remove.

However, when removing the sheets stacked in the sheet stacking portion 1, a user's hand may bump into the sheet pressing lever 2 and it is possible that a force may be applied in a direction which makes the sheet pressing lever 2 rotate even lower. In this case, the sheet pressing lever 2 may break.

Thus, a holding portion is provided for preventing breakage of the sheet pressing lever 2. The holding portion has an engagement portion 4 which holds the sheet pressing lever 2 so that it moves to the second position upwardly together with the image reading portion 18, and an elastic portion 5 which elastically deforms to release the holding of the sheet pressing lever 2 by the engagement portion 4. This will be described in further detail below.

[First Embodiment]

The holding portion of a first embodiment will be described below referring to FIGS. 2 to 5.

Figure 2A:
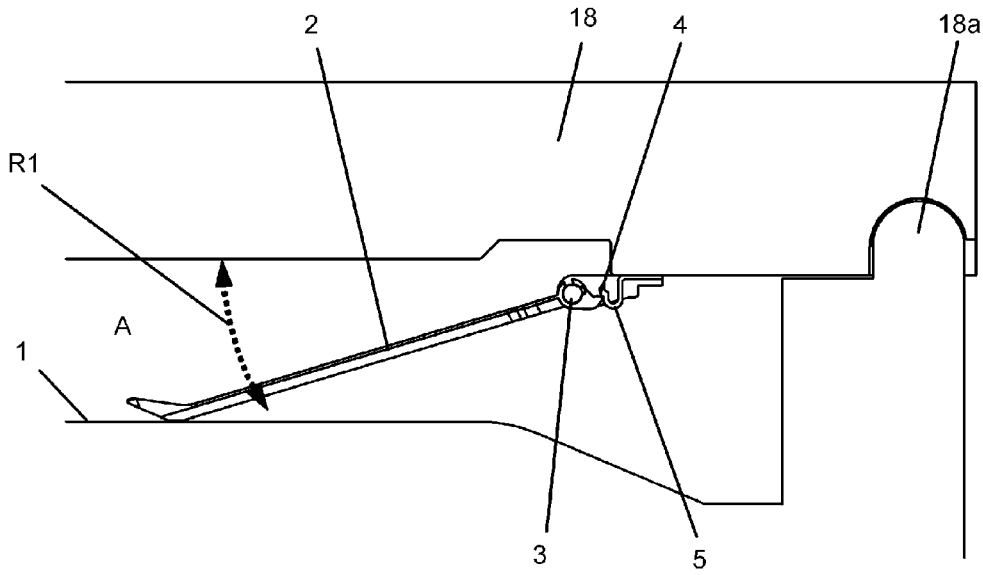
FIG. 2A is a diagram describing the operation when a sheet pressing lever is within a first movement region and FIG. 2B is a main portion perspective view illustrating the area near the sheet pressing lever axial support.
Figure 2B:
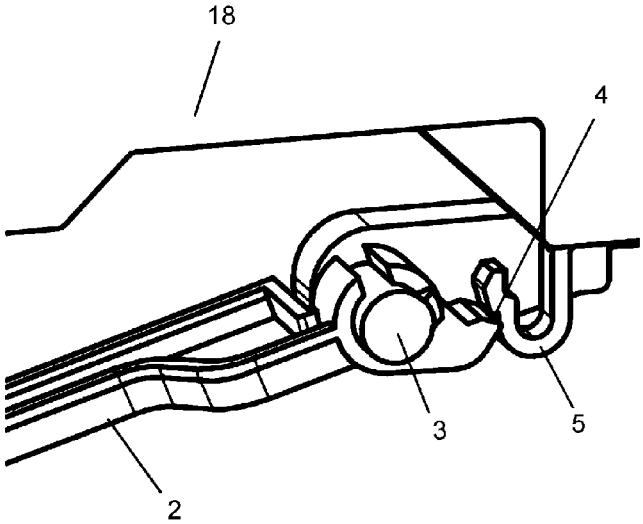

In the first embodiment, as illustrated in FIGS. 2A and 2B, the axial support 3 which rotatably axially supports the sheet pressing lever 2, and the engagement portion 4 for regulating the rotation region of the sheet pressing lever 2 are provided on the bottom surface of the image reading portion 18 which is above the pair of discharge rollers 55.

Figure 3A:
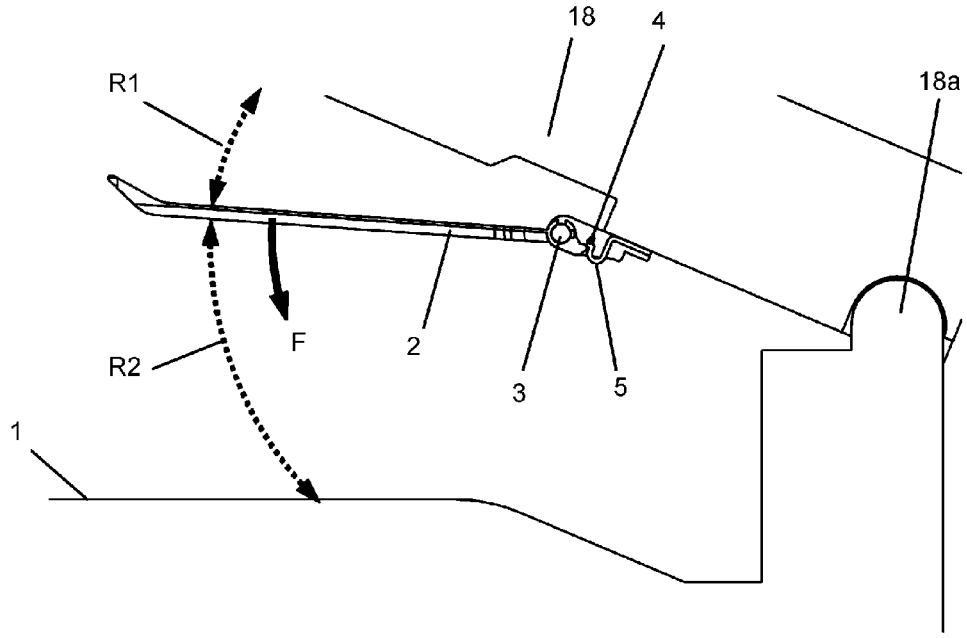
FIG. 3A is a diagram describing the operation when the sheet pressing lever is separated from the top surface of the sheet stacking portion and FIG. 3B is a main portion perspective view illustrating the area near the sheet pressing lever axial support.
Figure 3B:
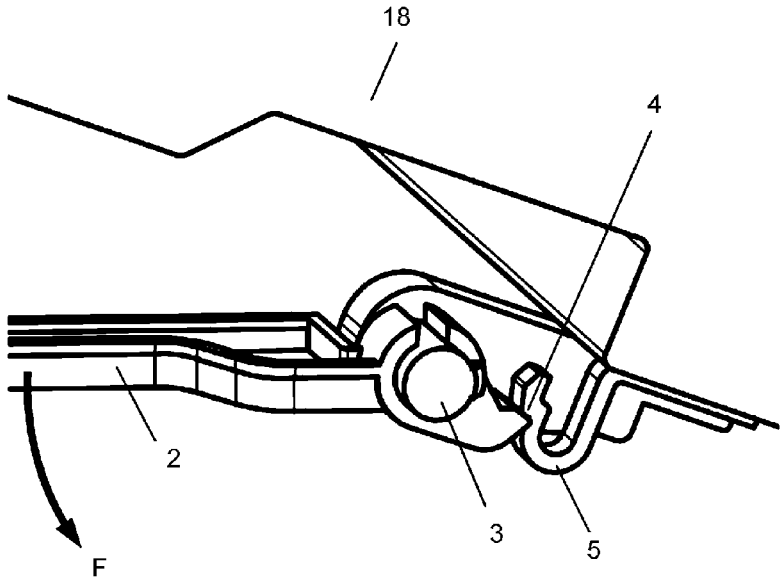
Figure 4A:
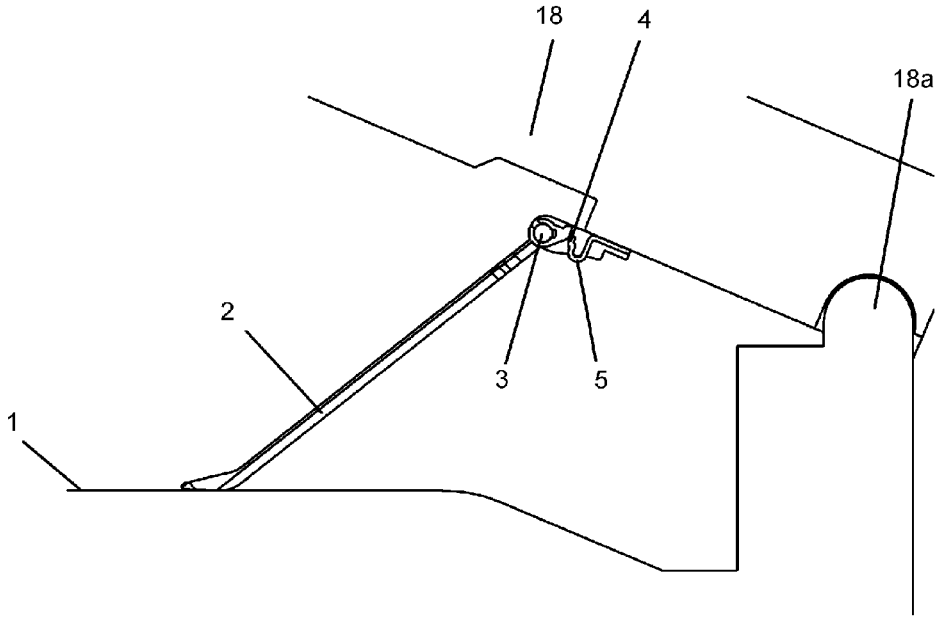
FIG. 4A is a diagram describing the operation when the sheet pressing lever has moved to a second movement region and is contacting with the top surface of the sheet stacking portion and FIG. 4B is a main portion perspective view illustrating the area near the sheet pressing lever axial support.
Figure 4B:
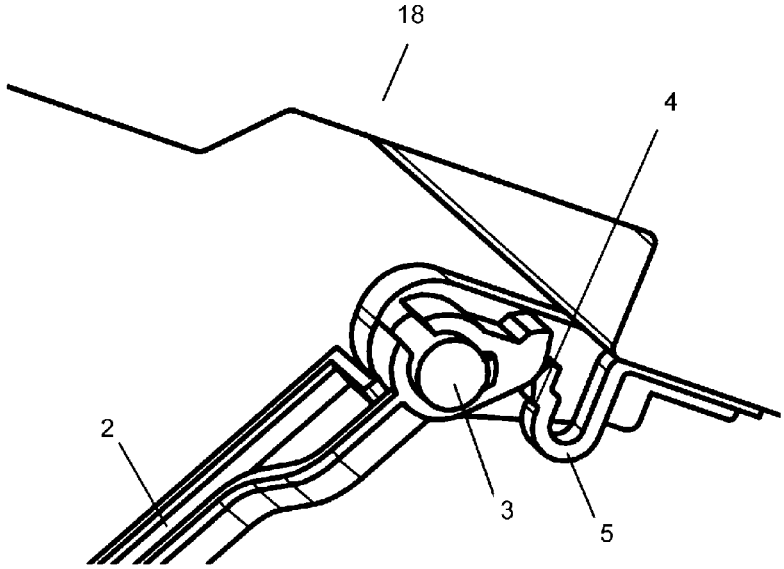

In the first position (state illustrated in FIG. 2A) in which the image reading portion 18 is closed, the rotation region of the sheet pressing lever 2 needed for pressing the top surface of the sheets 8 stacked in the sheet stacking portion 1 is a first movement region R1. As illustrated in FIG. 3A, when the image reading portion 18 is rotated upwardly, the engagement portion 4 engages with the sheet pressing lever 2 as illustrated in FIG. 3B and holds the sheet pressing lever 2 so that it moves together with the image reading portion 18. In other words, when the image reading portion 18 opens upward as illustrated in FIG. 3A, the engagement portion 4 holds the sheet pressing lever 2 in a lower limit position (holding position) of the first movement region R1 as illustrated in FIG. 3B. This holding position is a position so that the sheet pressing lever 2 maintains a predetermined angle with respect to the image reading portion 18. Thereby, when the image reading portion 18 is opened upward, the sheet pressing lever 2 also moves upward from the sheet stacking portion 1 together with the image reading portion 18.

Due to the above constitution, as illustrated in FIG. 3A, in the second position in which the image reading portion 18 is opened upward, a space is secured above the sheet stacking portion 1 which is larger than the stacking space A in the first position in which the image reading portion 18 is closed, and the sheets 8 stacked in the sheet stacking portion 1 become easy to remove.

However, when removing the sheets stacked in the sheet stacking portion 1, a user's hand may bump into the sheet pressing lever 2 and it is possible that a force may be applied in a direction which makes the sheet pressing lever 2 rotate even lower than the first movement region R1. In this case, a relatively large amount of force is normally applied to the axial support 3 and the engagement portion 4 of the sheet pressing lever 2, and the sheet pressing lever 2 or the axial support 3 may break.

Therefore, the holding portion described above is provided to avoid breakage of the sheet pressing lever 2. The constitution thereof will be described below referring to FIGS. 3 to 5.

In the first embodiment, as illustrated in FIG. 3B, the sheet pressing lever 2 is supported by the engagement portion 4 in the lower limit position of the first movement region R1 so as to maintain the predetermined angle with respect to the image reading portion 18. In other words, the engagement portion 4 and the elastic portion 5 are constituted integrally, and this integrally constituted holding portion is provided on the bottom surface of the image reading portion 18 together with the sheet pressing lever 2. When the engagement portion 4 releasably engages with the sheet pressing lever 2, the sheet pressing lever 2 is held in the holding position (lower limit position), and thereby the sheet pressing lever 2 can rotate in the upward direction, but the rotation of the sheet pressing lever 2 in the downward direction is regulated.

In the first embodiment, the engagement portion 4 and the elastic portion 5 are an integral member having a constitution utilizing the elastic deformation of resin materials. However, the holding portion is not limited to this constitution, and for example, the elastic portion 5 can be a flat spring or a wire spring and still achieve the same effects.

As illustrated in FIG. 3A, in the state in which the image reading portion 18 is opened upward, if a force F is applied in a direction which makes the sheet pressing lever 2 being held rotate even lower, the force is applied to the elastic portion 5 and the engagement portion 4 retracts due to the elastic deformation of the elastic portion 5. Thus, the holding of the rotation of the sheet pressing lever 2 is released. In other words, if a force F is applied in a direction which makes the sheet pressing lever 2 being held rotate even lower than the lower limit position, the elastic portion 5 elastically deforms due to the force F and the holding of the sheet pressing lever 2 by the engagement portion 4 is released (refer to FIG. 4B).

Due to the release of the holding of the sheet pressing lever 2, the sheet pressing lever 2 moves from the first movement region R1 to a second movement region R2 illustrated in FIG. 3A, and thereby breakage of the lever and the axial support can be avoided. The sheet pressing lever 2 which has been released from holding as described above rotates downward by its own weight to contact the top surface of the sheet stacking portion 1 (or the top surface of the sheets) (refer to FIGS. 4A and 4B). In the state in which the image reading portion 18 is opened upward, the second movement region R2 is a rotation region in which the rotating edge of the sheet pressing lever 2 which has been released from holding rotates in a direction approaching the sheet stacking portion 1 beyond the first movement region R1 until it comes into contact with the sheet stacking portion 1.

Figure 5A:
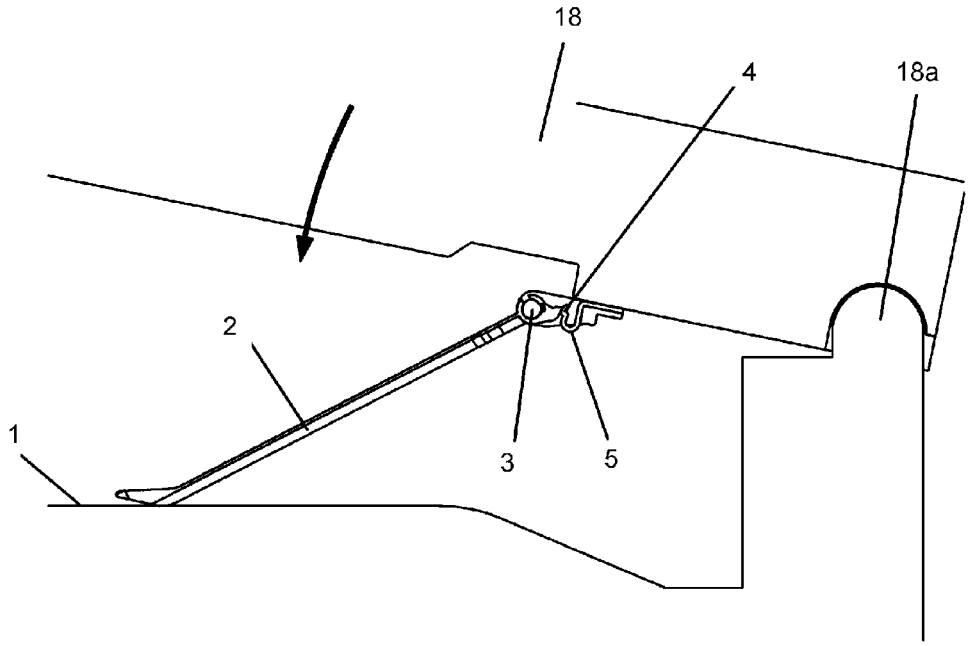
FIG. 5A is a diagram describing the operation when the sheet pressing lever 2 moves from the second movement region to the first movement region and FIG. 5B is a main portion perspective view illustrating the area near the sheet pressing lever axial support.
Figure 5B:
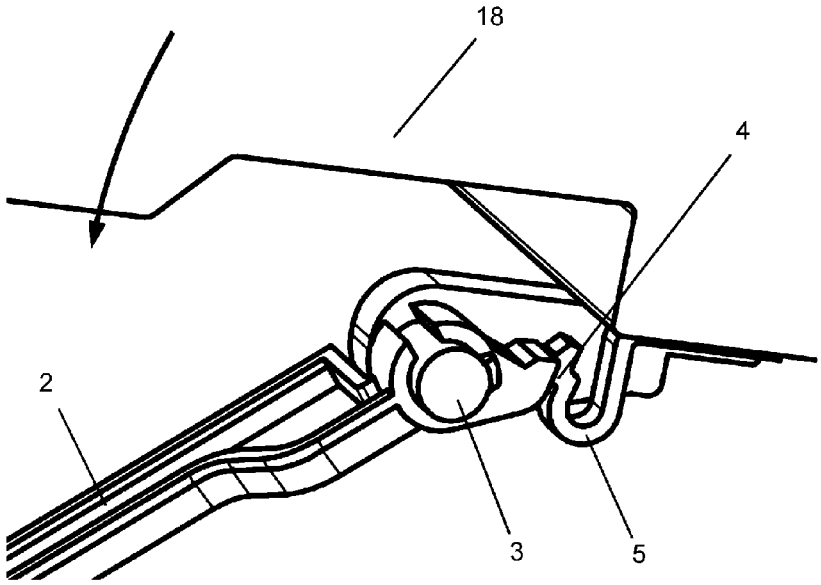

When the image reading portion 18 which has moved as described above is rotated back to its original state (the state in FIG. 2A), the sheet pressing lever 2 receives a force from the top surface of the sheet stacking portion 1 to make it rotate and it comes into contact with the engagement portion 4 and then the elastic portion 5 elastically deforms (refer to FIGS. 5A and 5B). Thereby, as illustrated in FIG. 2B, the engagement portion 4 returns to a state in which it can hold the sheet pressing lever 2. In other words, by simply closing the image reading portion 18, the sheet pressing lever 2 can be automatically returned to a state in which it can press the sheets regardless of whether the sheet pressing lever 2 is being held or is released from holding.

Since the first movement region R1 of the sheet pressing lever 2 is wider than the stacking space A and is secured by the engagement portion 4 when the image reading portion 18 is opened, the sheet pressing lever 2 is not held (regulated) by the engagement portion 4 in the state in which the image reading portion 18 is closed. In other words, in the state in which the image reading portion 18 is closed, the rotation of the sheet pressing lever 2 is not moved into the second movement region R2, and the sheet pressing lever 2 is rotatable within the stacking space A without being regulated by the engagement portion 4, and thus it functions effectively as a lever member.

According to the present embodiment, even if a force is applied to the sheet pressing lever being held by the holding portion in a direction which makes the lever rotate even lower, since the holding is released, the lever does not break.

In the embodiment described above, in the state in which the image reading portion 18 is closed, the rotating edge of the sheet pressing lever 2 comes into contact with the top surface of the sheet stacking portion 1. However, the present invention is not limited to this constitution. For example, in the state in which the image reading portion 18 is closed, taking into account an operation in which a user removes the sheets once and then returns the sheets again to the sheet stacking portion, the engagement portion 4 can be arranged so that a gap equivalent to two or three sheets exists between the rotating edge of the sheet pressing lever 2 and the top surface of the sheet stacking portion 1. This will be briefly described below.

In this case, in the first position in which the image reading portion 18 is closed, the engagement portion 4 is arranged so that the rotating edge of the sheet pressing lever 2 is held in the holding position (lower limit position) in a state in which it is separated from the top surface of the sheet stacking portion 1. By rotating the image reading portion 18 so that it moves upward, the sheet pressing lever 2 being held by the engagement portion 4 as described above moves upward together with the image reading portion 18. In the state in which the image reading portion 18 is opened upward, the movement in the case that a force F is applied in a direction which makes the sheet pressing lever 2 being held rotate even lower is the same as described above. In other words, even if a force F is applied to the sheet pressing lever 2 being held in a direction which makes it rotate even lower than the lower limit position, the elastic portion 5 elastically deforms due to the force F and the holding of the sheet pressing lever 2 by the engagement portion 4 is released. Therefore, the lever does not break.

Moreover, the contacting portion of the engagement portion 4 with the sheet pressing lever 2 is formed in a mountain shape as illustrated in FIGS. 2 to 5 so that the sheet pressing lever 2, which has been released from holding, will be held again by the engagement portion 4 if the image reading portion 18 is moved into a closed position. When the image reading portion 18 begins to close, the sheet pressing lever 2, which has been released from holding, comes into contact with the upwardly inclining surface of the mountain-shaped contacting portion as illustrated in FIG. 4B. Then the sheet pressing lever 2 receiving a force which rotates it in the closing direction of the image reading portion 18, and the elastic portion 5 elastically deforms due to the force and the engagement portion 4 retracts. Before the image reading portion 18 closes completely to the first position, the sheet pressing lever 2 passes the top of the mountain-shaped contacting portion of the engagement portion 4. After it passes the top, the sheet pressing lever 2 is pressed to the downwardly inclining surface of the mountain-shaped contacting portion of the engagement portion 4 by the force of the elastic portion 5 returning to its original state, and thus the sheet pressing lever 2 moves along the downwardly inclining surface to be held by the engagement portion 4 as illustrated in FIG. 2B. Afterwards, the image reading portion 18 closes completely to the first position, but at this time, the rotating edge of the sheet pressing lever 2 being held by the engagement portion 4 as described above is held in the lower limit position of the rotating region such that a gap exists between the rotating edge and the top surface of the sheet stacking portion 1. Thereby, even if a user removes the sheets once and then returns them again to the sheet stacking portion, the sheets will not fold.

[Second Embodiment]

Figure 6:
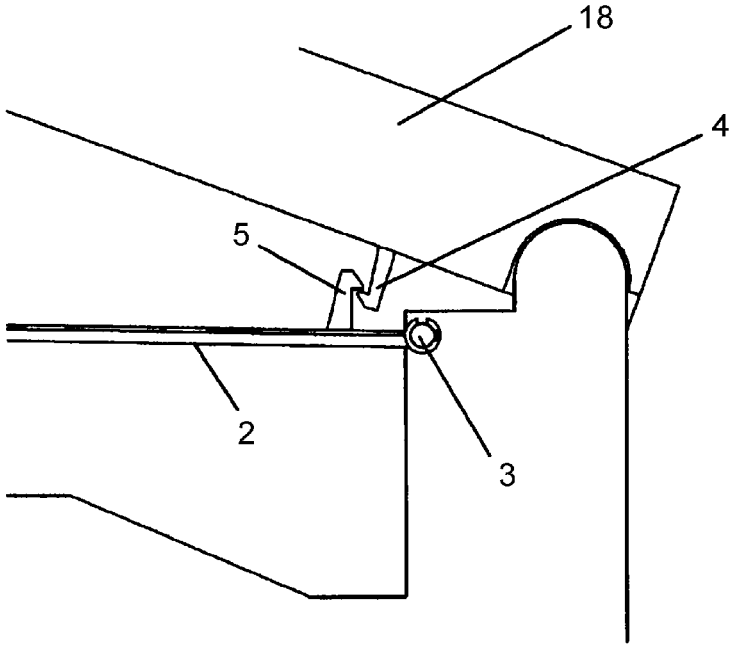
FIG. 6 is a descriptive view of the image forming apparatus according to a second embodiment, and illustrates the constitution of the sheet pressing lever and a holding portion thereof.

Next, the holding portion of a second embodiment will be described below with reference to FIG. 6. FIG. 6 is a descriptive view of the image forming apparatus according to the second embodiment, and this view illustrates the constitution of the lever member and the holding portion.

In the second embodiment, as illustrated in FIG. 6, the engagement portion 4 is provided on the image reading portion 18, and the elastic portion 5 is provided on the sheet pressing lever 2. The engagement portion 4 and the elastic portion 5 are constituted to releasably engage with each other so that the sheet pressing lever 2 is held in the holding position (lower limit position).

In the holding portion including the engagement portion 4 and the elastic portion 5, when the image reading portion 18 is rotated upward from a state in which the stacking space A is open, the engagement portion 4 and the elastic portion 5 engage with each other and hold the sheet pressing lever 2 so that it moves upward together with the image reading portion 18.

Due to the above constitution, in a state in which the image reading portion 18 is opened upward, a space is secured above the sheet stacking portion 1 which is larger than the stacking space A in the state in which the image reading portion 18 is closed, and the sheets 8 stacked in the sheet stacking portion 1 become easy to remove.

However, when removing the sheets stacked in the sheet stacking portion 1, a user's hand may bump into the sheet pressing lever 2 and it is possible that a force may be applied in a direction which makes the sheet pressing lever 2 rotate even lower than the first movement region R1. In this case, a relatively large amount of force is normally applied to the axial support 3 and the engagement portion 4 of the sheet pressing lever 2, and the sheet pressing lever 2 or the axial support 3 may break.

Therefore, the holding portion described above is provided to avoid breakage of the sheet pressing lever 2. The constitution thereof will be described below.

In the second embodiment, as illustrated in FIG. 6, the axial support 3 of the sheet pressing lever 2 which is a lever member is provided above the discharge portion (pair of discharge rollers 55) on the image forming portion 22, which makes up the apparatus main body. Further, as described above, the engagement portion 4 is provided on the image reading portion 18 and the elastic portion 5 is provided on the sheet pressing lever 2. As illustrated in FIG. 6, the engagement portion 4 and the elastic portion 5 releasably engage with each other, and thereby the sheet pressing lever 2 is held in the lower limit position (holding position) of the first movement region R1.

In the embodiment described above, the engagement portion 4 is provided on the image reading portion 18 and the elastic portion 5 is provided on the sheet pressing lever 2. However, the present invention is not limited to this constitution. The present invention can also be constituted such that the engagement portion 4 is provided on the sheet pressing lever 2 and the elastic portion 5 is provided on the image reading portion 18.

In the state in which the image reading portion 18 is opened upward, if a force F is applied in a direction which makes the sheet pressing lever 2 being held rotate even lower, the force is applied to the elastic portion 5 and its engagement with the engagement portion 4 is released due to the elastic deformation of the elastic portion 5. Thus, the holding of the rotation of the sheet pressing lever 2 is released. In other words, if a force F is applied in a direction which makes the sheet pressing lever 2 being held rotate even lower than the lower limit position, the elastic portion 5 elastically deforms due to the force F and the holding of the sheet pressing lever 2 by the engagement of the elastic portion 5 and the engagement portion 4 is released.

Due to the release of the holding of the sheet pressing lever 2, the sheet pressing lever 2 moves from the first movement region R1 to the second movement region R2, and thereby breakage of the lever can be avoided. The sheet pressing lever 2 which has been released from holding as described above rotates downward by its own weight to come into contact with the top surface of the sheet stacking portion 1 (or the top surface of the sheets). In the state in which the image reading portion 18 is opened upward, the second movement region R2 is a rotation region in which the rotating edge of the sheet pressing lever 2 which has been released from holding rotates in a direction approaching the sheet stacking portion 1 beyond the first movement region R1 until it comes into contact with the sheet stacking portion 1.

When the image reading portion 18 which has moved as described above is rotated back to its original state, the sheet pressing lever 2 receives a force to make it rotate, and then the engagement portion 4 of the image reading portion 18 comes into contact with the elastic portion 5 of the sheet pressing lever 2, and the elastic portion 5 elastically deforms. Thereby, the engagement portion 4 and the elastic portion 5 return to a state in which they can hold the sheet pressing lever 2. In other words, by simply closing the image reading portion 18, the sheet pressing lever 2 can be automatically returned to a state in which it can press the sheets regardless of whether the sheet pressing lever 2 is being held or is released from holding.

The first movement region R1 of the sheet pressing lever 2 is wider than the stacking space A, and the sheet pressing lever 2 is held by the engagement of the engagement portion 4 and the elastic portion 5 when the image reading portion 18 is opened as described above. Therefore, in the state in which the image reading portion 18 is closed, the engagement portion 4 and the elastic portion 5 do not engage with each other, and the rotation of the sheet pressing lever 2 is not regulated. In other words, in the state in which the image reading portion 18 is closed, the rotation of the sheet pressing lever 2 is not moved into the second movement region R2, and the sheet pressing lever 2 is rotatable within the stacking space A without being regulated by the holding portion, and thus it functions effectively.

Since the other constitutions are similar to the embodiments described above, descriptions thereof will be omitted.

According to this embodiment of the present invention, even if a force is applied to the sheet pressing lever held by the holding portion in a direction which makes the lever rotate even lower, the lever will not break since the holding is released.

[Other Embodiments]

In the embodiments described above, the lever member was the sheet pressing lever 2 which presses sheets discharged into the sheet stacking portion 1. However, the lever member is not limited to this constitution. For example, the lever member can be a detecting portion which detects the height in the stacking direction of the sheets stacked in the sheet stacking portion.

Further, in the embodiments described above, a sheet stacking apparatus which discharges and stacks sheets, as a recording target, in the sheet stacking portion was described. However, the present invention is not limited to this constitution. For example, the same effects can be obtained even if the present invention is applied to a sheet stacking apparatus which discharges and stacks sheets such as the original copy, as a reading target, in the sheet stacking portion.

In addition, in the embodiments described above, a sheet stacking apparatus in which the image forming apparatus is provided integrally was described. However, the present invention is not limited to this constitution. For example, the sheet stacking apparatus can be freely detachable from the image forming apparatus, and the same effects can be obtained even if the present invention is applied to such a sheet stacking apparatus. Specifically, the present invention is still effective even in a sheet stacking apparatus such as a sheet processing apparatus in which the sheets on which an image is formed are selectively subjected to processing such as binding and then stacked.

Moreover, in the embodiments described above, an image reading portion was exemplified as an upper unit rotatably provided above the sheet stacking apparatus or the apparatus main body of the image forming apparatus. However, the present invention is not limited to this constitution, and another upper unit can be used such as a sheet processing apparatus which subjects the sheets to processing.

Furthermore, in the embodiments described above, a multifunction machine which combines functions was exemplified as the image forming apparatus. However, the present invention is not limited to this constitution. For example, another image forming apparatus can be used such as a scanner, printer, copying machine, fax machine, and the like. The same effects can be obtained even if the present invention is applied to a sheet stacking apparatus used in these kinds of image forming apparatuses.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-163415, filed Jul. 10, 2009, and No. 2010-143393, filed Jun. 24, 2010, which are hereby incorporated by reference herein in their entirety.

What is claimed is:

1. A sheet stacking apparatus comprising:

a main body of the apparatus which includes a discharge portion from which a sheet is discharged;

a sheet stacking portion, provided on a top of the main body, on which a sheet discharged from the discharge portion is stacked;

an upper unit, which can be provided at a closed position in which the upper unit is separated from the sheet stacking portion by a stacking space for stacking the sheets, and which can move upward from the closed position to an open position in which a larger space than the stacking space is formed;

a lever member rotatably provided on a bottom surface of the upper unit so as it come into contact with the sheet stacked in the sheet stacking portion from above; and a holding portion which holds the lever member in a predetermined holding position so as to maintain a predetermined angle with the bottom surface of the upper unit to restrict downward rotation of the lever member in the larger space when the upper unit moves to the open position, wherein, when the upper unit has moved to the open position, if a force in a direction which makes the lever member rotate lower than the predetermined holding position is applied to the lever member held in the predetermined holding position by the holding portion, the holding portion releases the holding of the lever member.

2. The sheet stacking apparatus according to claim 1, wherein the holding portion holds the lever member elastically.

3. The sheet stacking apparatus according to claim 2, wherein the lever member is held in a lower limit position by the releasable holding of the holding portion.

4. The sheet stacking apparatus according to claim 3, wherein the lever member which has been released from holding comes into contact with the sheet stacking portion when the upper unit moves to the closed position, then the lever member receives a force to rotate from the sheet stacking portion, and then the holding portion holds the lever member elastically again.

5. The sheet stacking apparatus according to claim 1, wherein the lever member has a detecting portion which detects the height in the stacking direction of sheets stacked in the sheet stacking portion.

6. The sheet stacking apparatus according to claim 1, wherein the upper unit is an image reading unit which reads an image of an original.

7. An image forming apparatus comprising:

a main body of the apparatus which includes an image forming portion which forms an image on sheets and a discharge portion from which an image formed sheet is discharged;

a sheet stacking portion, provided on a top of the main body, on which a sheet discharged from the discharge portion is stacked;

an upper unit, which can be provided at a closed position in which the upper unit is separated from the sheet stacking portion by a stacking space for stacking the sheets, and which can move upward from the closed position to an open position in which a larger space than the stacking space is formed;

a lever member rotatably provided on a bottom surface of the upper unit so as to come into contact with the sheet stacked in the sheet stacking portion from above; and a holding portion which holds the lever member in a predetermined holding position so as to maintain a predetermined angle with the bottom surface of the upper unit to restrict downward rotation of the lever member in the larger space when the upper unit moves to the open position, wherein, when the upper unit has moved to the open position, if a force in a direction which makes the lever member rotate lower than the predetermined holding position is applied to the lever member held in the predetermined holding position by the holding portion, the holding portion releases the holding of the lever member.

8. The image forming apparatus according to claim 7, wherein the holding portion holds the lever member elastically.

9. The image forming apparatus according to claim 8, wherein the lever member is held in a lower limit position by the releasable holding of the holding portion.

10. The image forming apparatus according to claim 9, wherein the lever member, which has been released from holding, comes into contact with the sheet stacking portion when the upper unit moves to the closed position, then the lever member receives a force to rotate from the sheet stacking portion, and then the holding portion holds the lever member elastically again.

11. The image forming apparatus according to claim 7, wherein the lever member has a detecting portion which detects the height in the stacking direction of sheets stacked in the sheet stacking portion.

12. The image forming apparatus according to claim 7, wherein the upper unit is an image reading unit which reads an image of an original.

* * * * *